United States Patent [19]

Smith

[11] 4,295,676

[45] Oct. 20, 1981

[54] PATIO DOOR SECURITY LOCK

[76] Inventor: James A. Smith, 1314 Kingstown Pkwy., Smyrna, Ga. 30080

[21] Appl. No.: 112,216

[22] Filed: Jan. 15, 1980

[51] Int. Cl.[3] ..... E05C 17/30

[52] U.S. Cl. ..... 292/262; 292/DIG. 46

[58] Field of Search ..... 292/262, 268, 338, 339, 292/263, DIG. 46

[56] References Cited

U.S. PATENT DOCUMENTS

| | | | |
|---|---|---|---|
| 1,722,736 | 7/1929 | Derbyshire | 292/268 |
| 3,328,920 | 7/1967 | Cohen et al. | 49/449 |
| 3,420,001 | 1/1969 | Raymon | 49/407 |
| 3,471,189 | 10/1969 | Ness | 292/266 |
| 3,486,781 | 12/1969 | Crum | 292/262 |
| 3,608,940 | 9/1971 | Mueller | 292/338 X |
| 3,615,114 | 10/1971 | Harris | 292/288 |
| 3,816,967 | 6/1974 | Littrell | 292/262 |
| 3,820,285 | 6/1974 | Shiffler et al. | 292/262 |
| 3,821,884 | 7/1974 | Walsh | 292/262 |
| 4,079,479 | 3/1978 | Clement | 49/449 |

*Primary Examiner*—Richard E. Moore

*Attorney, Agent, or Firm*—Jones, Thomas & Askew

[57] ABSTRACT

A locking bar for use with sliding doors such as patio doors or the like, and permitting the sliding door to be securely locked either in a fully-closed position or in an ajar position. The locking bar includes a pair of telescoping members that are adjustably interconnected to have either a greater or a lesser length. One of the telescoping members selectably attaches to a keeper on the sliding door, and is nonremovably retained in the keeper whenever the shorter length is selected so that the door may be ajar, or optionally when the door is locked in the fully-closed position.

11 Claims, 8 Drawing Figures

PATIO DOOR SECURITY LOCK

BACKGROUND OF INVENTION

This invention relates in general to locking apparatus, and in particular to apparatus for locking sliding panel doors such as patio doors or the like.

So-called "patio doors" generally include a pair of panel members, usually made of glass, mounted in coplanar relation within a frame. One of the panels is usually supported for sliding movement relative to the other panel, within a track typically contained in or formed by the frame, so that the door panel can be slidably opened or closed relative to the fixed panel. Patio doors have found widespread acceptance in houses and apartments, due to the ease of opening a relatively large area and the amount of daylight illumination provided by such doors.

The popularity of the conventional patio door has caused corresponding problems in home security, because these doors in conventional construction are relatively susceptible to unauthorized opening by intruders or the like. Although most sliding patio doors come equipped with some type of locking mechanism, the typical standard-equipment patio door lock may be relatively flimsy and easily jimmied or broken by an experienced burglar. Some such locks can be thwarted simply by inserting a thin object such as a knife blade between the door frame and the forward edge of the door, so as to withdraw a spring-loaded latch. Patio door locks having a deadbolt type of construction, which cannot be jimmied in the foregoing manner, can nevertheless be overcome simply by inserting a pry bar between the frame and the adjacent door edge, and then forcing the two elements apart until the bolt is withdrawn from the frame.

Various devices have been proposed in the art for increasing the locking security of a patio door, so that an intruder or other unauthorized person cannot force the door unless he resorts to smashing the entire glass panel. One such prior-art locking device, known as the "Charley bar", is shown in U.S. Pat. No. 3,328,920, and consists of a locking bar that may be inserted between a pair of brackets, one bracket being attached to the movable door panel and the other bracket being attached to a stationary member such as the frame or the like. While locking devices such as the Charley bar are relatively effective for securing a patio door in the fully-closed position, many people also want to securely lock their patio door slightly ajar. For example, a person having household pets may wish to secure the patio door ajar so as to leave an opening too small for a human to pass, but sufficiently wide to allow a cat or small dog to enter or leave. Other persons may simply desire to leave a patio door ajar for ventilation at night time or while they are away from home, without leaving the patio door unlocked or subject to forceable entry.

While devices have been proposed in the art that permit adjustable closure locking of patio doors, such devices are believed to have been generally impracticable due to expense, complexity, or difficulty of installing without mutilating the structure of the door.

SUMMARY OF INVENTION

Stated in general terms, the patio door lock of the present invention secures a sliding door panel in at least two selected positions, one of which may be the fully-closed position and the other of which may be an ajar position with the sliding panel ajar. Locking according to the present invention is accomplished with a locking bar which extends between the movable door panel and a stationary member, and which can be locked in either of two extensible positions. Stated somewhat more specifically, the patio door lock of the present invention includes a pair of bar elements that are adjustably interconnected to provide a locking bar of at least two discrete selectable lengths. One end of the locking bar is secured to a stationary member such as the door frame, and the other end of the locking bar is selectively connectable to an engagement member secured to the sliding panel. The other end of the locking bar is freely removable from the engagement member when the bar is fully extended to lock the sliding panel in its closed position. When the locking bar is manipulated to permit the sliding panel to open a limited distance, however, the other end of the locking bar becomes retained within the engaging member and thus cannot be withdrawn from that member. The locking bar thus is secured to the slidable panel so long as that panel remains ajar, thereby preventing anyone from disconnecting the locking bar simply by reaching through the ajar door.

Accordingly, it is an object of the present invention to provide an improved security lock for a patio door or the like.

It is another object of the present invention to provide a patio door security lock which locks the door in either of two positions.

It is another object of the present invention to provide an improved patio door security lock which can secure an ajar door against unauthorized entry.

Other objects and advantages of the present invention will become more readily apparent from the following description of the disclosed preferred embodiment.

DESCRIPTION OF PREFERRED EMBODIMENT

Figure 1:
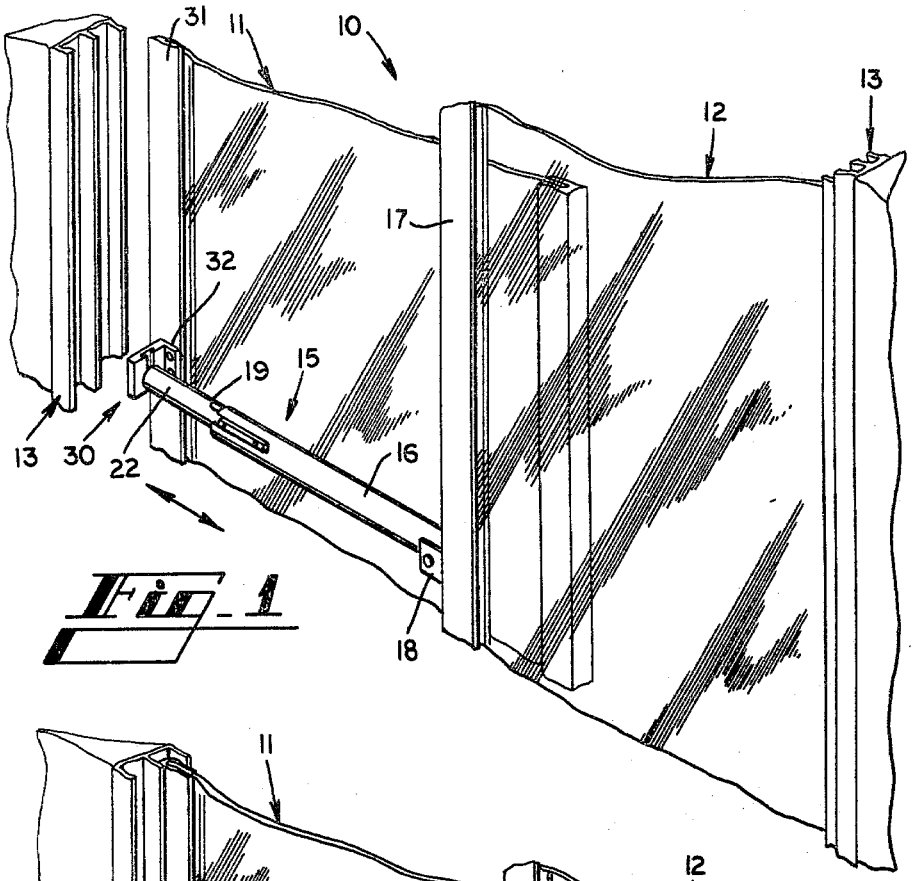
FIG. 1 is a pictorial view showing a broken-away sliding patio door locked in an ajar position by a security lock according to a preferred embodiment of the present invention.
Figure 2:
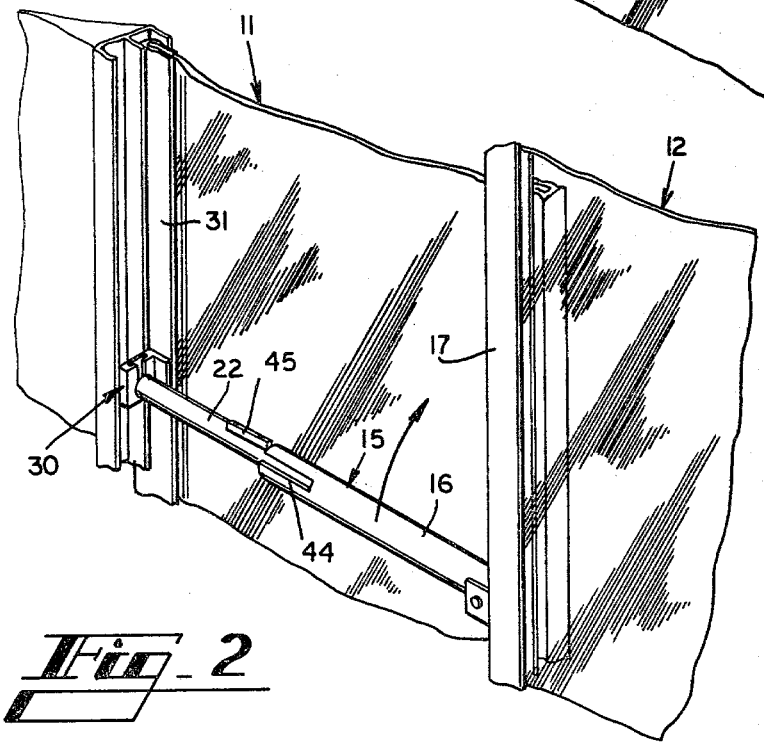
FIG. 2 shows the embodiment of FIG. 1 locking the door in fully-closed position.

Turning to FIGS. 1 and 2, there is shown generally at 10 a patio door having a sliding panel 11 and a fixed panel 12, each of which is mounted within a frame assembly fragmentarily indicated at 13. It will be understood by those skilled in the art that the conventional sliding panel or door 11 is supported by rollers or the like for sliding movement along a track (not shown) provided by the upper and lower portions of the frame assembly 13. The patio door 10 is viewed in FIG. 1 from the inside of a room, so that the sliding panel 11 slides along the outside or exterior of the fixed panel 12, in the disclosed embodiment. The opposite arrangement, i.e., the sliding panel mounted for sliding movement along the inside of the fixed panel, is also known and can be locked with the security lock of the present invention, as is explained below in greater detail.

A locking bar 15 according to the preferred embodiment of the present invention is shown in locking operation in FIGS. 1 and 2. The locking bar 15 includes a first tubular member 16 secured at one end to the vertical frame member 17 of the fixed panel 12 by means of the bracket 18, which preferably has a pivotable connection to the first tubular member for a purpose described below. The length of the first tubular member 16 in the disclosed embodiment is chosen so that the free end 19 of that member is positioned approximately midpoint on the width of the sliding panel 11, although the length of the first tubular member is not critical to the operation of the invention.

A second tubular member 22 is telescopically received within the hollow interior of the first tubular member 16. The exterior of the second tubular member 22 has a circular cross-section, as does the interior of the first tubular member 16, and the relative diameters of the two members are chosen so that the second tubular member is free to slide and to rotate within the first tubular member. The two tubular members 16 and 22 together make up a locking bar 15 which is telescopically extensible, as becomes more apparent below.

Disposed at the free end 23 of the second tubular member 22 is the locking cam 24, secured to the shank 25 interconnected between the free end 23 and the locking cam. The locking cam 24, as most clearly seen in FIG. 5, takes the shape of a plate that is elongated along a major axis perpendicular to the length of the second tubular member 22, and vertically oriented in the sight of FIGS. 5 and 6. Relative to the longitudinal axis of the second tubular member 24, the upper end 26*a* and lower end 26*b* of the locking cam 24 define end points of the major axis and have a radial spacing greater than that of the sides 27*a* and 27*b*, defining the minor axis of the locking cam.

Figure 3:
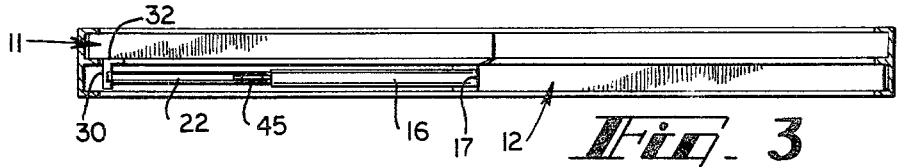
FIG. 3 is a semi-schematic plan view showing the embodiment of FIG. 1.
Figure 4:
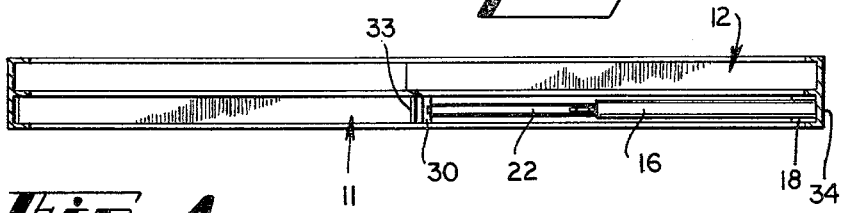
FIG. 4 is a semi-schematic plan view showing the disclosed embodiment attached to an inside-opening patio door.
Figure 5:
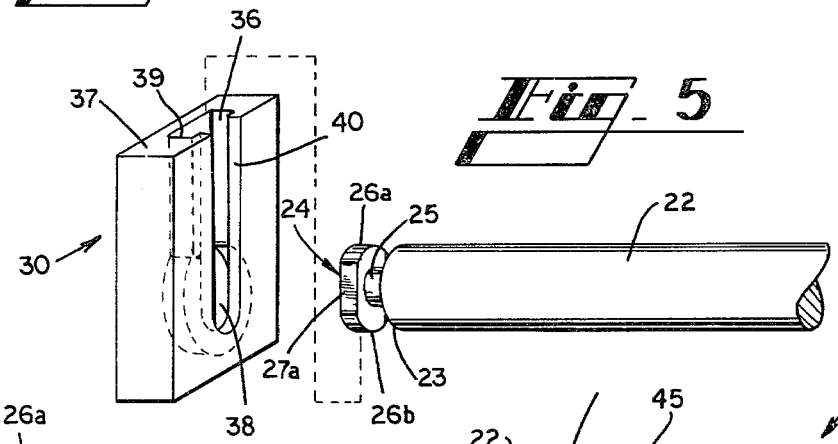
FIG. 5 is a detailed pictorial view showing the locking cam and keeper structure of the disclosed embodiment.

The locking cam 24 is selectably engaged by the keeper 30, shown in detail in FIG. 5. The keeper 30 is normally secured to the sliding panel 11 by any suitable means, so as to be in facing relation with the locking cam 24. In the case of a patio door having an outside sliding panel, as shown in FIGS. 1–3, the keeper 30 may be secured to the forward vertical frame member 31 of the sliding panel 11 by means of a suitable bracket, such as the mounting plate 32 shown in FIG. 1. Alternatively, where the present security lock is applied to a patio door having an inside sliding panel as shown in FIG. 4, the keeper 30 can be attached directly to the rear vertical frame member 33 of the sliding panel; by mounting screw holes (not shown) provided in the keeper for that purpose the mounting bracket 18 associated with the first tubular member 16 would then be attached to the frame member 34, forming part of the frame assembly 13 and located behind the sliding panel.

A T-shaped vertical slot 36 is formed in the keeper 30, extending downwardly from the upper face 37 of the keeper, with the open throat 40 of the slot facing the locking cam 24. The enlarged inner end 39 of the slot 36 terminates at an enlarged keeper region 38 within the keeper 30. The diameter and depth of the keeper region 38 are sufficient to permit the elongated locking cam 24 to be received for rotation within the keeper region, although the inner end 39 of the slot 36 is wide enough to accommodate the locking cam 24 only when the major axis or elongate dimension of that cam is longitudinally aligned with the length of the slot 36. It will be understood that the shank 25 between the locking cam 24 and the free end 23 of the second tubular member 22 freely fits within the relatively narrow throat 40 of the slot 36.

Figure 6:
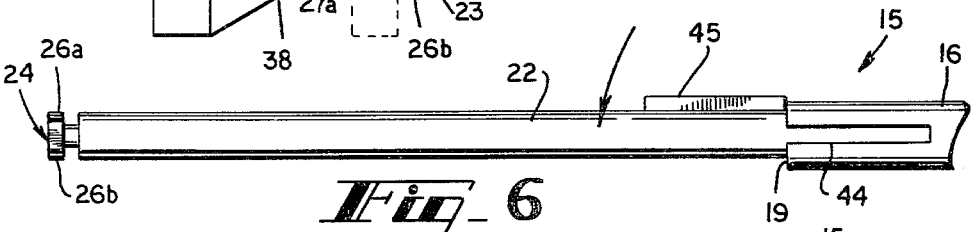
FIG. 6 is a detailed elevation view showing the extended locking bar of the disclosed embodiment, in position to be inserted in or withdrawn from the keeper assembly.
Figure 7:
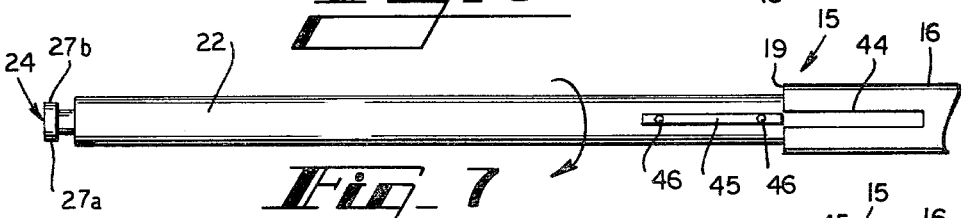
FIG. 7 shows a view similar to FIG. 6, with the locking bar rotated to engage the keeper assembly.
Figure 8:
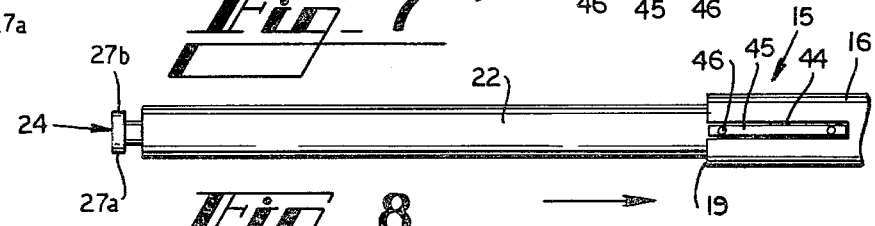
FIG. 8 shows an elevation view similar to FIGS. 6 and 7, with the locking bar telescoped to permit ajar positioning of the patio door as shown in FIG. 1.

The locking bar 15 is provided with means for selectably limiting the extent of telescoping movement, as best seen in FIGS. 6–8. A longitudinal slot 44 extends rearwardly a distance from the free end 19 of the first tubular member 16. A motion stop 45, here shown in the shape of a narrow rectangular member whose thickness is slightly less than the width of the slot 44, is secured to the exterior of the second tubular member 22 with screws 46, FIG. 7.

The installation and operation of the present patio door security lock is now considered. Assuming the lock is to be installed on an outside-opening door of the type shown in FIGS. 1–3, the locking bar 15 is first installed by attaching the bracket 18 to a convenient point on the frame member 17 of the adjacent fixed panel 12. Although the locking bar 15 may be installed at any desired elevation, it may be desirable to locate the locking bar substantially at waist height for ease of operation. The keeper 30 is next attached to the vertical frame member 31 at the forward edge of the sliding panel 11, preferably at an elevation substantially coinciding with the elevation of the bracket 18 for mounting the locking bar 15.

Once the bracket 18 and the keeper 30 are installed, the sliding panel 11 is closed and the locking bar 15 inserted in approximately the position shown in FIG. 2, with the locking cam 24 inserted through the T-shaped slot 36 in the keeper 30. The motion stop 45, which was previously unattached to the second tubular member 22, can now be placed on that tubular member in position proximate to the free end 19 of the first tubular member 16, as best shown in FIGS. 2 and 6. The position of the motion stop 45 on the second tubular member 22 should be marked, after which the second tubular member can be removed from the keeper 30 and from the first tubular member 16 to facilitate attaching the motion stop at the marked location. The motion stop can be attached by drilling holes in the second tubular member 22 to accommodate screws 46.

When the two tubular members 16 and 22 have been reassembled after installing the motion stop, it will be understood that the sliding panel 11 of the patio door 10 can be locked in fully-closed position (FIG. 2) simply by placing the locking cam 24 in the slot 36 of the keeper. The second tubular member 22 remains rotated to the position shown in FIGS. 2 and 6, so that the motion stop 45 remains misaligned with the slot 44 in the first tubular member 16. The sliding panel 11 thus is locked in its fully-closed position by the locking bar 15.

Whenever it is desired to lock the sliding panel 11 in the ajar position as shown in FIG. 1, the sliding panel is first moved to its fully-closed position so that the locking cam 24 can enter the slot 36 of the keeper 30. The tubular member 22 must be rotationally positioned as shown in FIG. 6 at this time, to permit the locking cam 24 to enter the slot 36 in the keeper. As soon as the locking cam 24 enters the keeper region 38 within the keeper 30, the second tubular member 22 may now be manually rotated one-quarter turn to the position shown in FIG. 7, thus placing the motion stop 45 in alignment with the slot 44 in the first tubular member 16. The sliding panel 11 may now be slidably opened, causing the second tubular member 22 to telescope into the first tubular member 16 while the motion stop 45 enters the slot 44. It will be understood that the sliding panel may thus be opened only to an extent determined by the length of the slot 44.

Even though a would-be intruder can reach through the ajar sliding panel to grasp the locking bar 15, that intruder cannot remove the locking bar from the keeper 30 because the quarter-turn rotation of the second tubular member 22 placed the major axis of the locking cam crosswise relative to the width of the inner end or head 39 of the slot 36, thus retaining the locking cam within the keeper. The would-be intruder obviously cannot rotate the second tubular member 22 to align the locking cam with the slot 36, because the presence of the motion stop 45 within the slot 44 (FIG. 1) prevents such rotation while the locking bar 15 remains telescoped by the ajar sliding panel 11.

It will thus be seen that the locking bar 15 cannot be withdrawn while the sliding panel remains ajar, so that security of the sliding panel is maintained even though the sliding panel is sufficiently open to permit a measure of ventilation, access for household pets, or the like. When the locking bar 15 is not in use, it may be pivoted about the bracket 18 to an upright position substantially parallel with the frame member 17 of the fixed panel. A suitable clip or securing device (not shown) may be provided for retaining the locking bar 15 in the upright position, when not in use.

By placing the locking cam 24 in the keeper 30 of the fully-closed sliding panel 11 as shown in FIG. 6 and then rotating the tubular member 22 one-quarter turn in the opposite direction from FIG. 7, i.e., so that the motion stop 45 is radially disposed 180° out of alignment with the slot 44, the locking cam is retained in the keeper while the locking bar is fully extended. The locking bar 15 thus cannot be jimmied out of locking engagement with a fully-closed sliding panel 11 by a wire or other implement forced past the edge of the closed door panel, which might otherwise be feasible where the locking bar is installed behind an inside sliding panel as shown in FIG. 4.

Although the locking bar 15 could be supplied to users complete with the motion stop 45 attached to the second tubular member 22, that arrangement fixes the amount of possible telescoping movement of the locking bar and may be unsuitable for sliding patio doors wider or narrower than a specific size for which the locking bar was designed. Providing the locking bar with unattached motion stop, as described above, allows a locking bar of specific maximum telescopic extension to be usable with patio doors or other sliding panels of various widths.

It should be understood that the foregoing relates only to a disclosed preferred embodiment of the present invention, and that numerous changes or modifications may be made therein without departing from the spirit or the scope of the invention as defined in the following claims.

I claim:

1. Locking apparatus for use with a pair of panels at least one of which is mounted for sliding movement between an open position and a closed position in parallel relation to the other panel, said locking apparatus comprising:

a first member disposed to be stationary with respect to said sliding panel;

a second member selectably connectable to the sliding panel and being selectably extensible with respect to said first member to occupy at least two positions relative to said first member;

said second member when in one such position cooperating with said first member to maintain said sliding panel at a closed position; and said second member when in another such position cooperating with said first member to permit said sliding panel to occupy a partially open position, and operatively associated with said sliding panel to prevent disconnection of said second member from said partially open sliding panel.

2. Locking apparatus for use with a closure having a pair of panels at least one of which is slidably movable between an open position and a closed position relative to the other panel, said locking apparatus comprising:

first means for mounting alongside said closure in fixed relation with respect to one of said panels;

second means connected to said first means and selectably operative either to a first state wherein said second means is extensible to undergo a limited first extent of movement in the direction that the slidable panel can move, or to a second state wherein the extensibility of said second means is limited to undergo substantially less movement in said direction; and keeper means associated with said movable panel to receive said second means and operative to retain said second means when in said first state, so that said second means in said first state permits the movable panel to be moved no more than said limited first extent from the closed position while being retained on said movable panel by said keeper means.

3. Locking apparatus as in claim 2, wherein:

said first means and said second means are mutually rotatable so as to select either said first state, permitting a limited extent of telescopic relative movement, or to said second state permitting substantially less telescopic movement.

4. Locking apparatus as in claim 2, wherein said keeper means engages and retains said second means in said first state but not in said second state, so that said second means when in said second state can be withdrawn from said keeper means and removed from locking relation with said panels.

5. Locking apparatus as in claim 2, wherein:

said second means is selectably rotatable to assume either of said first and second states; and said second means includes engagement means for receiving by said keeper means;

said engagement means being engaged and retained by said keeper means when said second means is rotated to said first state, and said engagement means being releasably engaged by said keeper means when said second means is rotated to said second state.

6. Locking apparatus as in claim 5, wherein said means for limiting telescopic movement comprises:

a longitudinal aperture on one of said first and second means, the length of said aperture corresponding to said limited extent of telescopic movement; and a member on the other of said first and second means, said member being operative to enter said aperture and permit said limited extent of telescopic movement only when said second means is moved to said first position.

7. Locking apparatus as in either of claims 5 or 6, wherein:

said engagement means comprises a shank portion associated with said second means, and an elongated head portion connected to said shank portion; and said keeper means comprises an opening to rotatably receive said shank portion and operative to receive said elongated head portion only when said first and second means are rotated to said second position; and a keeper region communicating with said opening and operative to receive and engage said elongated portion for rotation therein, so that said elongated head portion of said engagement means when in said second position can be inserted through said opening for retention in said keeper region, and can thereafter be rotated to said first position for retention in said keeper region.

8. Locking apparatus as in claim 2, wherein:

said first means and said second means are mutually rotatable so as to select either said first state, permitting a limited extent of telescopic relative movement, or to said second state permitting substantially less telescopic movement; and said first means and said second means are mutually rotatable to select a third state permitting said less telescopic movement and retaining said second means by said keeper means, so that the movable panel is retained in the closed position while said second means is nonremovably associated with the movable panel.

9. Locking apparatus for use with a closure having a pair of panels at least one of which is slidably movable between an open position and a closed position relative to the other panel, said locking apparatus comprising:

first means for mounting alongside said closure in fixed relation with respect to one of said panels;

second means connected to said first means and selectably operative either to a first state to undergo a limited extent of movement in the direction that the slidable panel can move, or to a second state to undergo substantially less movement in said direction;

said first means and said second means being telescopically interconnected to undergo said limited amount of movement; and keeper means associated with said movable panel to receive said second means and operative to retain said second means when in said first state, so that said second means in said first state permits the movable panel to be moved a limited extent from the closed position while being retained on said movable panel by said keeper means.

10. Locking apparatus for use with a closure having a pair of panels at least one of which is slidably movable between an open position and a closed position relative to the other panel, said locking apparatus comprising:

first means for mounting alongside said closure in fixed relation with respect to one of said panels;

second means connected to said first means and selectably operative either to a first state to undergo a limited extent of movement in the direction that the slidable panel can move, or to a second state to undergo substantially less movement in said direction;

keeper means associated with said movable panel to receive said second means and operative to retain said second means when in said first state, so that said second means in said first state permits the movable panel to be moved a limited extent from the closed position while being retained on said movable panel by said keeper means;

said first means said second means being telescopically interconnected, and being mutually movable either to a first position corresponding to said first state or to a second position corresponding to said second state;

means on said first and second means limiting the extent of said telescopic movement in response to said rotation, so that a limited extent of said telescopic movement is permitted in said first position and substantially less telescopic movement is permitted in said second position; and engagement means associated with said second means and operative to be received by said keeper means;

said engagement means being removably engaged by said keeper means when said second means is moved to said second position, and being nonremovably retained by said keeper means when said second means is moved to said first position.

11. Locking operating as in claim 2, wherein:

said second means is selectably operative to a third state permitting only said substantially less movement, and wherein said keeper means retains said second means, so that said second means maintains the movable panel in the closed position and said keeper means retains said second means on the movable panel.

* * * * *